US011426645B2

(12) United States Patent
Irvin

(10) Patent No.: US 11,426,645 B2
(45) Date of Patent: Aug. 30, 2022

(54) GOLF BALL PUTTING ALIGNMENT SYSTEM AND METHOD

(71) Applicant: Michael Irvin, Erie, PA (US)

(72) Inventor: Michael Irvin, Erie, PA (US)

( * ) Notice: Subject to any disclaimer, the term of this patent is extended or adjusted under 35 U.S.C. 154(b) by 0 days.

(21) Appl. No.: 17/021,886

(22) Filed: Sep. 15, 2020

(65) Prior Publication Data

US 2021/0077883 A1 Mar. 18, 2021

Related U.S. Application Data

(60) Provisional application No. 62/900,724, filed on Sep. 16, 2019.

(51) Int. Cl.
*A63B 69/36* (2006.01)

(52) U.S. Cl.
CPC ..... *A63B 69/3685* (2013.01); *A63B 69/3688* (2013.01)

(58) Field of Classification Search
CPC ..... A63B 69/3685; A63B 69/3688
USPC ..... 473/251–254, 243, 231, 238, 286, 282, 473/313, 314, 340, 341; 294/19.2
See application file for complete search history.

(56) References Cited

U.S. PATENT DOCUMENTS 676,506 A * 6/1901 Knight ..... A63B 69/3688 473/268
1,531,821 A * 3/1925 Scott ..... A63B 60/52 473/328
1,960,110 A * 5/1934 Iles ..... A63B 47/02 473/286
2,465,124 A * 3/1949 Quattrin ..... A63B 69/3632 473/235
3,632,112 A * 1/1972 Jacobs ..... A63B 47/02 473/286
3,708,172 A * 1/1973 Rango ..... A63B 47/008 473/249
3,753,565 A * 8/1973 Baker ..... A63B 69/3655 473/266
3,841,640 A * 10/1974 Gaulocher ..... A63B 69/3685 473/249
4,209,172 A * 6/1980 Yamamoto ..... A63B 69/3685 473/200
4,248,430 A * 2/1981 Kepler ..... A63B 53/007 473/285
4,580,784 A * 4/1986 Brill ..... A63B 57/00 473/286
5,417,426 A * 5/1995 Bayer ..... A63B 57/353 473/285
5,692,968 A * 12/1997 Shine ..... A63B 60/00 473/286
6,422,949 B1 * 7/2002 Byrne ..... A63B 69/3688 473/200

(Continued)

*Primary Examiner* — Sebastiano Passaniti
(74) *Attorney, Agent, or Firm* — MMI Intellectual Property; Jonathan D'Silva

(57) ABSTRACT

A golf ball aligning device comprises a shaft having a first and a second end, a handle mounted to the first end and a head member mounted to the second end. The head member further comprises a ball opening extending through the height of the head member having a chamfered or rounded bottom edge to engage a golf ball. An alignment grid on the top face of the head member comprises a crosshair pattern centered with the ball opening. A golf ball engaged with the bottom edge may be manipulated and oriented relative to the alignment grid for setting the trajectory of a shot.

2 Claims, 17 Drawing Sheets

(56) References Cited

U.S. PATENT DOCUMENTS 6,634,955 B2 * 10/2003 Middleton ..... A63B 53/0487 473/231
6,702,688 B2 * 3/2004 Hale ..... A63B 69/3676 473/226
7,059,971 B1 * 6/2006 Schmitt ..... A63B 60/50 473/285
D572,325 S * 7/2008 Baer ..... D21/746
7,458,899 B2 * 12/2008 Michaud ..... A63B 69/3685 473/226
7,846,036 B2 * 12/2010 Tanaka ..... A63B 53/0487 473/286
8,162,773 B1 * 4/2012 Pingalore ..... A63B 69/3685 473/231
8,632,415 B1 * 1/2014 Smith ..... A63B 47/04 473/286
D704,781 S * 5/2014 Pak ..... D21/736
8,777,775 B2 * 7/2014 Johnson ..... B25G 3/26 473/286
9,440,125 B1 * 9/2016 Myers ..... A63B 60/50
D791,254 S * 7/2017 Ramsauer ..... D21/744
10,773,145 B2 * 9/2020 Gardner ..... A63B 53/0487
10,940,370 B2 * 3/2021 Morris ..... A63B 53/0487
2003/0013539 A1 * 1/2003 Scott ..... A63B 69/3632 473/409
2003/0109319 A1 * 6/2003 Andresen ..... A63B 45/02 473/200
2004/0147334 A1 * 7/2004 D'Agguano ..... A63B 53/0487 473/286
2004/0166952 A1 * 8/2004 Park ..... A63B 53/0487 473/249
2005/0197205 A1 * 9/2005 Hale, Jr. ..... A63B 67/002 473/340
2007/0155535 A1 * 7/2007 Bunker ..... A63B 69/3685 473/340
2009/0186718 A1 * 7/2009 Ross ..... A63B 53/0487 473/340
2010/0009781 A1 * 1/2010 Vanderbilt ..... A63B 47/008 473/409

* cited by examiner

10b

GOLF BALL PUTTING ALIGNMENT SYSTEM AND METHOD

BACKGROUND

Putting in the game of golf constitutes over 40% of a player's end score. When putting, players align the face of their club with the golf ball and visualize a target line to swing the club to connect with the ball to move the golf ball along an imaginary target line. If the player cannot properly get the golf ball rolling on their intended target line, then there is little possibility of the ball going into the hole. What is presented is a system and method to more quickly orient the golf ball on the intended target line and enable square contact between the ball and the face of the putter to produce a straight putt.

SUMMARY

A golf ball aligning device comprises a shaft having a first and a second end. A handle is mounted to the first end and a head member is mounted to the second end. The head member further comprises a ball opening extending through the height of the head member having a chamfered or rounded bottom edge to engage a golf ball. An alignment grid is located on the top face of the head member. The alignment grid comprises a crosshair pattern centered with the ball opening. A golf ball engaged with the bottom edge may be manipulated and oriented relative to the alignment grid for setting the trajectory of a shot.

The ball opening in the head member is typically less than the diameter of a golf ball. In some embodiments, the chamfered or rounded bottom edge of the ball opening has a high surface finish or coating to reduce friction when manipulating a golf ball. Some embodiments may comprise an insert made from a low-friction material having a chamfered or rounded inner edge that is press fit into a counterbore in the ball opening at the bottom face of the head member.

The golf ball aligning device could have head member of any appropriate design. Some embodiments of head members could have a plurality of legs extending downwards from the head member to support the golf ball aligning device in an upright position when not engaged with a golf ball.

In some embodiments of golf ball aligning device the head member is a putter head that comprises a flat front face for striking a golf ball. The top face of some putter heads could comprise at least two parallel lines oriented perpendicular to the front face for positioning the putter head relative to a golf ball that has been oriented using the alignment grid.

The ball opening is preferably a circular opening through the head member. But some embodiments could have a ball opening that is a semi-circular opening on one edge of the head member.

The golf ball aligning device is used to align the trajectory of a golf ball shot. Preferably, the golf ball has target crosshairs marked on its surface. The player selects a projected trajectory for a golf ball shot and places the golf ball on a golf game surface at the beginning of the projected trajectory with the target crosshairs aligned as close as possible with the direction of the projected trajectory. The user then engages the golf ball in the chamfered or rounded bottom edge of the golf ball alignment device such that the alignment grid is oriented with the target crosshairs on the surface of the golf ball. The golf ball is oriented with the alignment device such that the alignment grid lines up the golf ball in the direction of the projected trajectory. The alignment device is then removed from over the ball such that the target crosshairs remain oriented in the direction of the desired trajectory. The player then aligns a golf club with the target crosshairs on the golf ball such that the striking face will contact the golf ball at the correct position and angle to drive the golf ball in the desired trajectory.

Those skilled in the art will realize that this invention is capable of embodiments that are different from those shown and that details of the devices and methods can be changed in various manners without departing from the scope of this invention. Accordingly, the drawings and descriptions are to be regarded as including such equivalent embodiments as do not depart from the spirit and scope of this invention.

BRIEF DESCRIPTION OF DRAWINGS

For a more complete understanding and appreciation of this invention, and its many advantages, reference will be made to the following detailed description taken in conjunction with the accompanying drawings.

DETAILED DESCRIPTION

Figure 1:
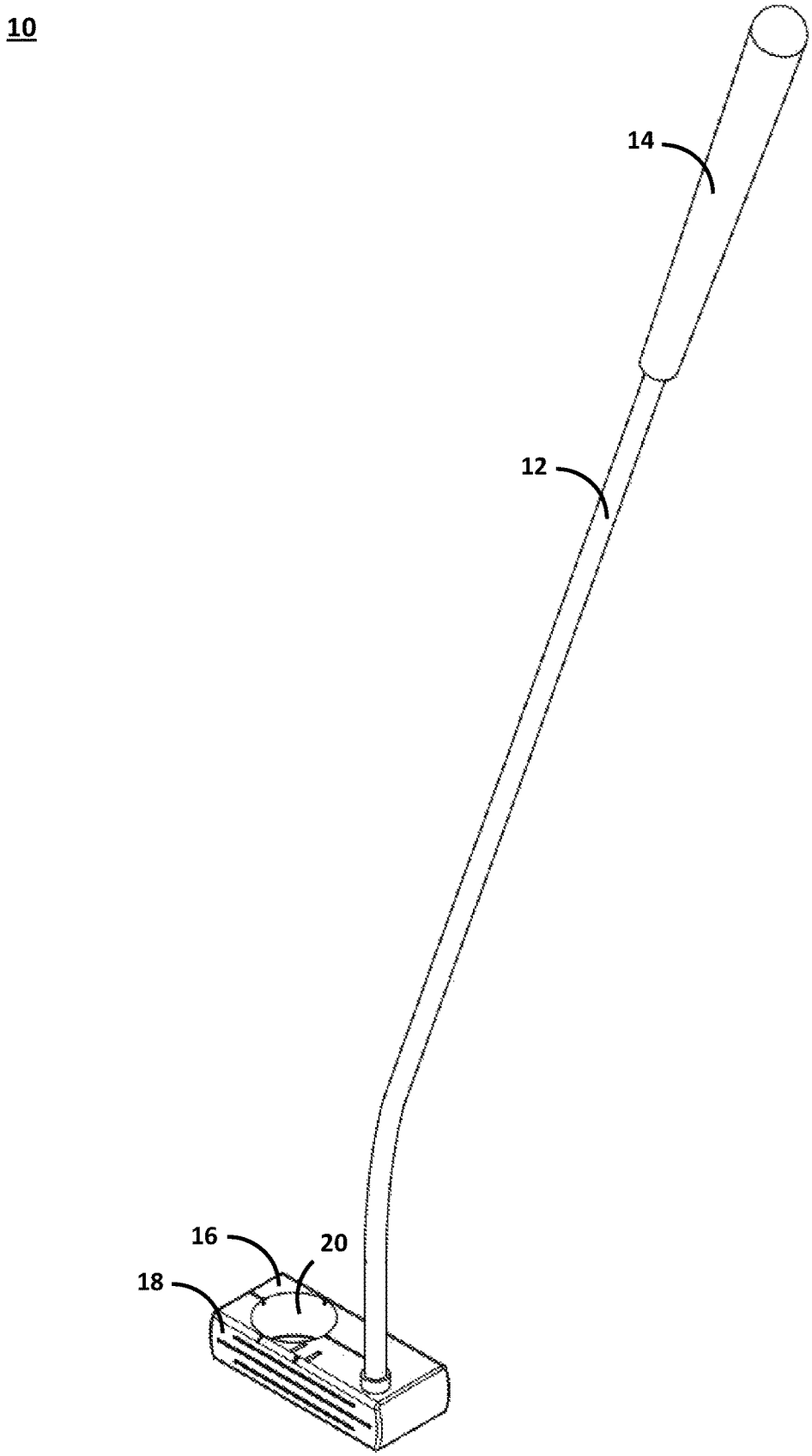
FIG. 1 is a perspective view of an embodiment of golf ball aligning device.

Referring to the drawings, some of the reference numerals are used to designate the same or corresponding parts through several of the embodiments and figures shown and described. Corresponding parts are denoted in different embodiments with the addition of lowercase letters. Variations of corresponding parts in form or function that are depicted in the figures are described. It will be understood that variations in the embodiments can generally be interchanged without deviating from the invention.

Many golfers have adopted the practice of marking their golf balls with lines on the surface of the ball to help with the alignment of the putt. One drawback to this practice is the time it takes to accomplish this. Many golfers get frustrated when playing with people who are slow, especially when lining up their putts. All players who marked balls to aid in putting must crouch down close to the green and try and line up the markings on the golf ball to the intended line of the putt. The player then stands up to double check the alignment of the ball from a different angle. Many times, it takes multiple adjustments of the ball to get the exact position of the line. This new system and method of lining up a putt is faster and more efficient and makes for quicker play around the green.

Another problem associated with trying to align a putt in this way is that people with bad hips, knees, or ankles struggle to use this method with the constant strain of having to bend over and crouch down many times just to make one putting stroke. It is substantially easier to line up a putt from the standing position rather than crouched down behind it. The disclosed system and method provide a better, faster, and safer way to line up a golf putt so that people of all ages and skill levels can align marked balls more effectively and have more fun playing the great game of golf.

Several U.S. patents teach methods of putting using various designs of golf clubs intended to help align a putt. Some also teach about body position, hand grip, or angle of the putter face and shaft of the club to achieve a more squarely struck shot. The present disclosure goes much further than just using lines on a putter to help with aligning the direction of the putt.

Figure 2:
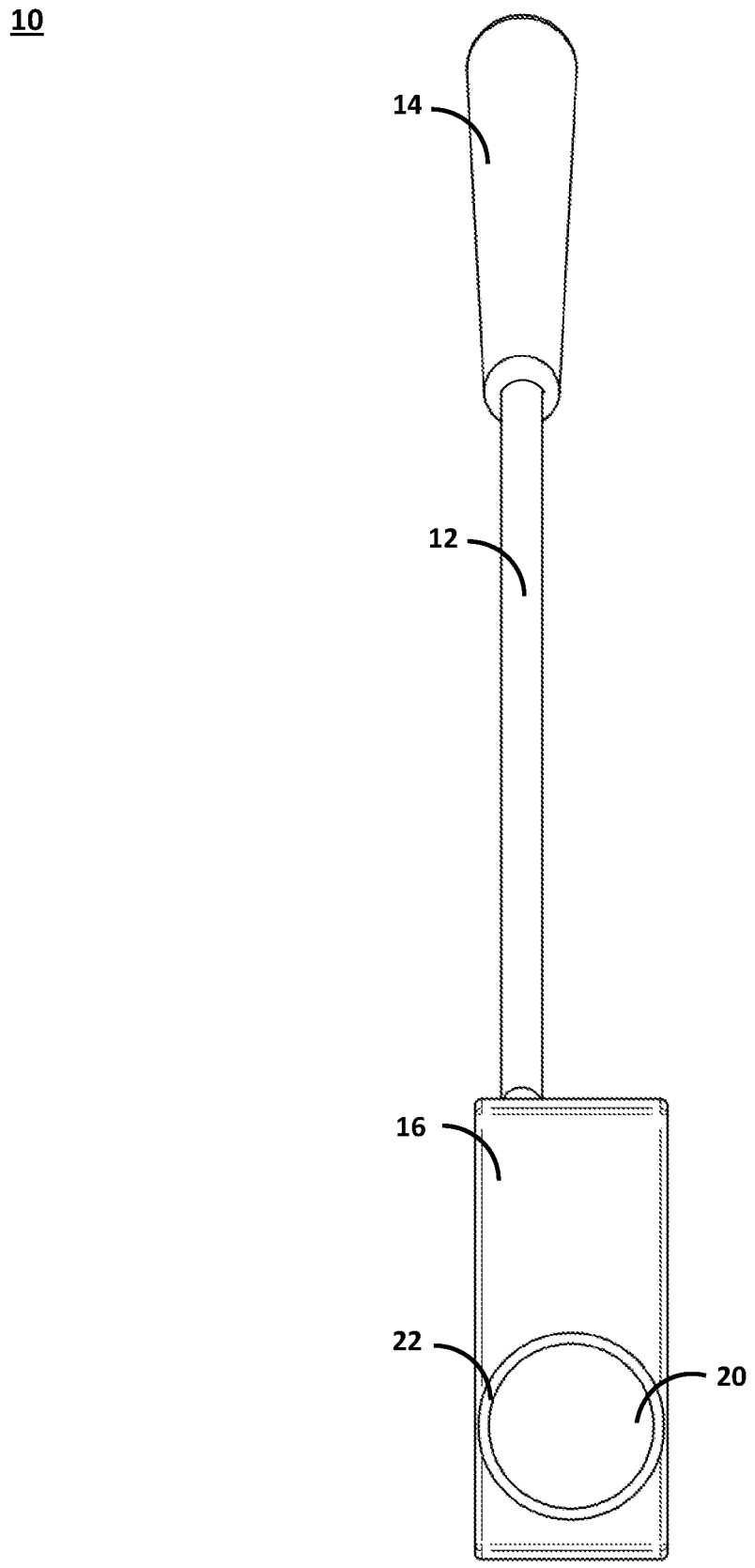
FIG. 2 is a bottom view of the golf ball aligning device of FIG. 1.

FIG. 1 shows a golf ball aligning device 10 that in this embodiment is a golf club, specifically a putter. The golf ball aligning device 10 comprises a shaft 12 having a first and a second end. A handle 14 is mounted to the first end and a head member 16 is mounted to the second end. The head member 16 in this is embodiment is a putter head that comprises a flat front face 18 for striking a golf ball. The head member 16 further comprises a ball opening 20 that extends through the height of the head member 16. As best seen in the bottom view shown in FIG. 2, in the embodiment shown, the ball opening 20 is a circular opening that has a chamfered or rounded bottom edge 22 that engages with a golf ball.

Figure 3:
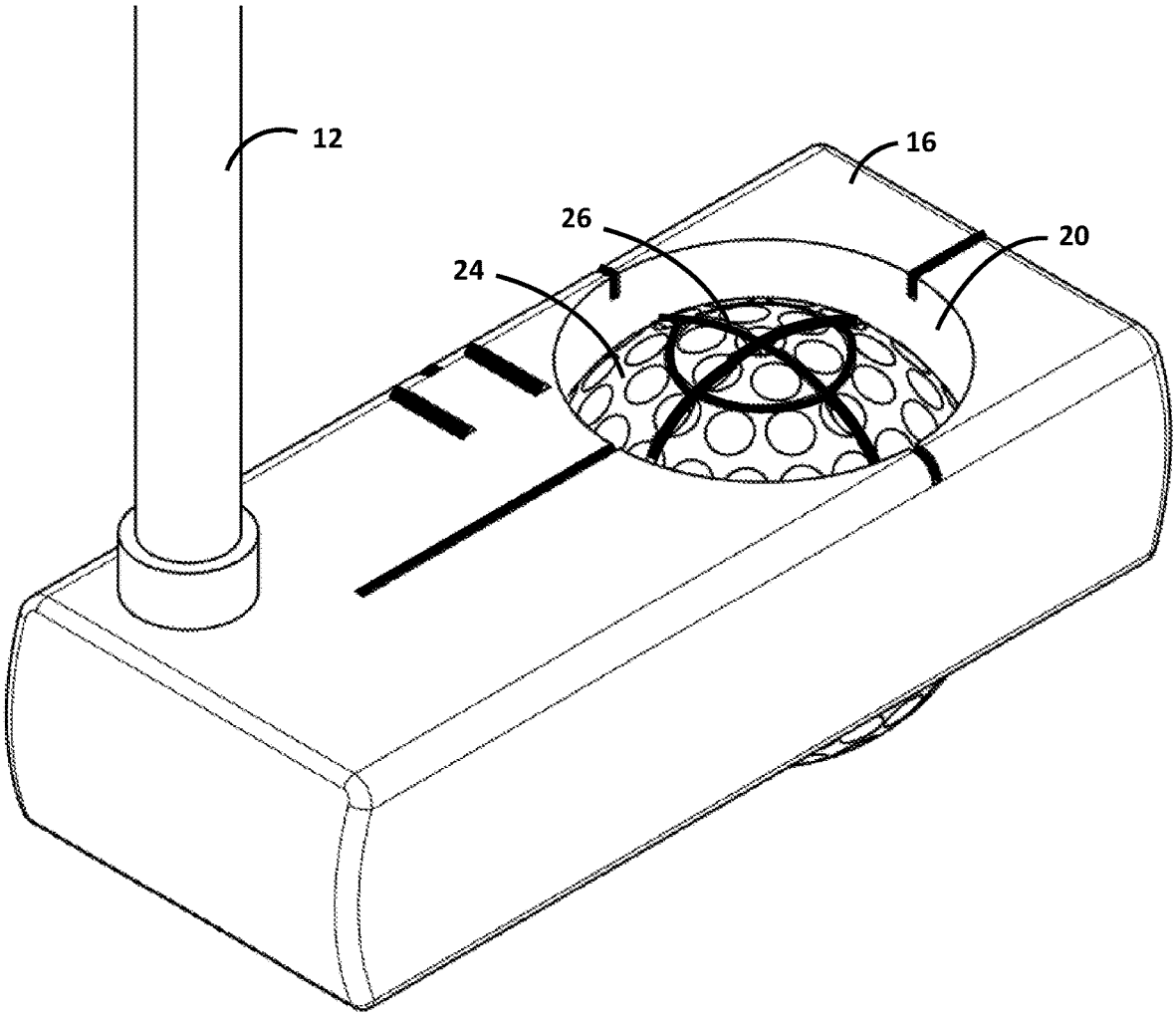
FIG. 3 is a close up view of the golf ball aligning device of FIG. 1 with a golf ball positioned in the ball opening.
Figure 4:
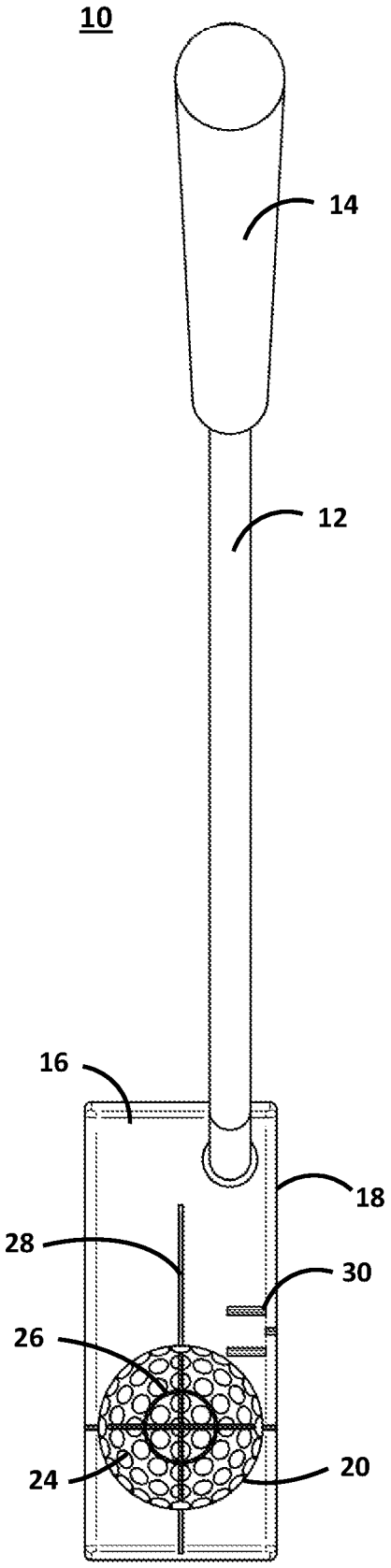
FIG. 4 is a top view of the golf ball aligning device of FIG. 1 with a golf ball positioned in the ball opening.

FIGS. 3 and 4 shows the golf ball aligning device 10 engaging with a golf ball 24. The ball opening 20 in the head member 16 is less than the diameter of a golf ball 24 which allows the gold ball 24 to engage with the bottom edge 22. In various embodiments, the bottom edge 22 of the ball opening 20 could have a high surface finish or coating to reduce friction when manipulating the golf ball 24. The golf ball 24 is shown marked with target crosshairs 26 that assist the player in aiming. Such target crosshairs 26 may be printed on the golf ball 24 by the manufacturer or may be added by the player. If added by the player, commercially available templates are available to create custom markings on golf balls using felt tip markers or pens. However the golf ball is marked, the golf ball aligning device 10 allows the player to rotate the golf ball 24 from a standing position to line up a shot and give a visual indication of where to strike the golf ball 24 so that it moves in a desired trajectory.

Figure 5:
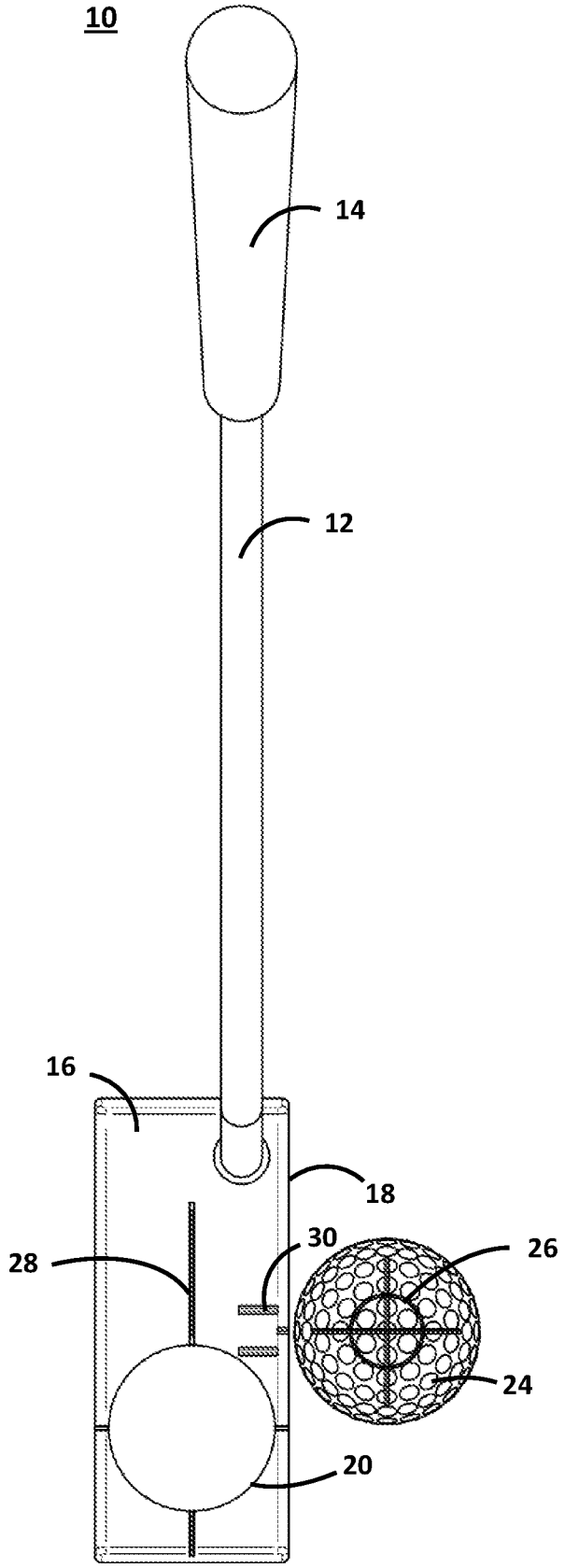
FIG. 5 is a top view of the golf ball aligning device of FIG. 1 with a golf ball positioned ready to be hit by the putting head.

FIGS. 3 and 4 also show an alignment grid 28 on the top face of the head member 16. The alignment grid 28 comprises a crosshair pattern centered with the ball opening 20. As shown in FIG. 4, a golf ball 24 engaged with the bottom edge 22 may be manipulated and oriented relative to the crosshair pattern of the alignment grid 28 for setting up the trajectory of a shot. As shown in FIG. 5, the flat front face 18 of the head member 16 has a striking grid 30 at the top face of head member 16. In this embodiment, the striking grid 30 comprises two parallel lines oriented perpendicular to the front face 18 for positioning the head member 16 relative to the golf ball 24 that has been oriented using the alignment grid 28.

Figure 19:
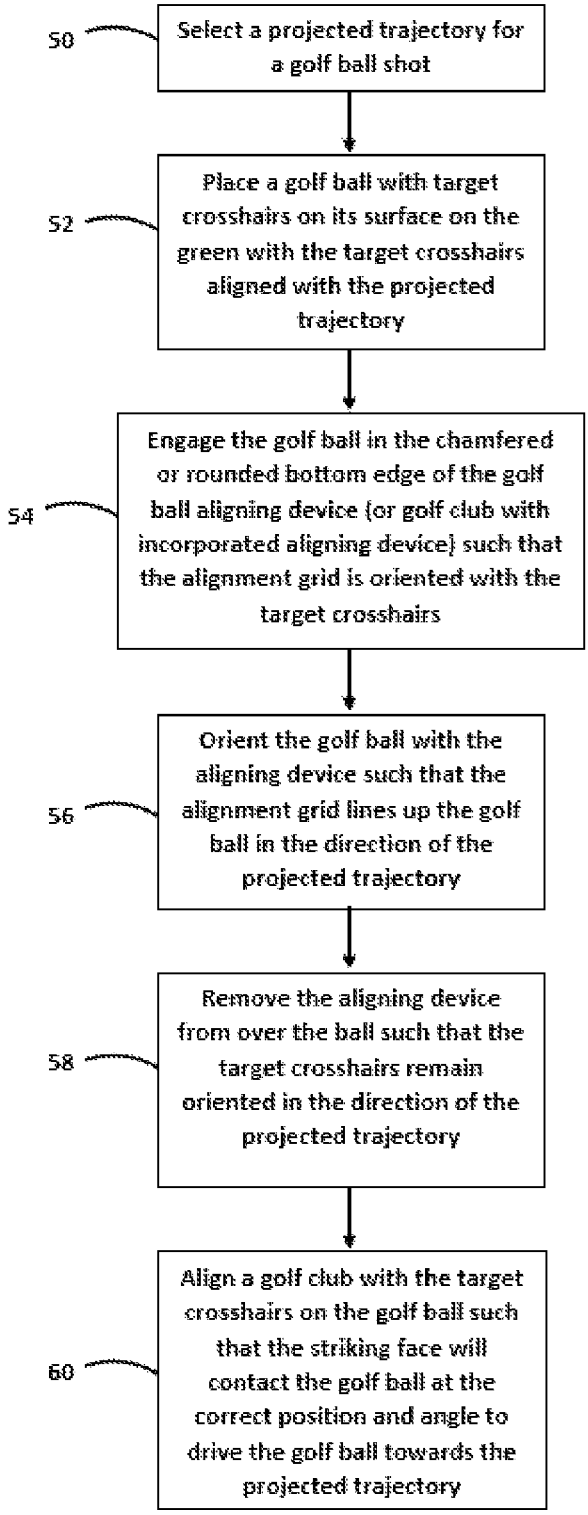
FIG. 19 is a flow chart showing the method disclosed herein.

The golf ball aligning device 10 would be used when on the putting surface of the green before striking the golf ball 24. FIG. 19 shows a flowchart illustrating the steps of using the system described herein. As best understood by comparing FIGS. 3, 4, 5, and 19, the player would first approach the golf ball 24 that is on the green and "mark" the spot on the green directly behind the golf ball 24 using whatever acceptable means that fall under the rules of golf. After a "mark" is placed behind the golf ball 24, the player can pick up the golf ball 24, clean it if needed, and then decide a trajectory for the golf ball 24 to follow in order to make the putt 50. The player would then set the golf ball 24 back down on the green, in front of the mark that they had previously set down, with the target crosshairs 26 as close to the projected trajectory of the putt 52 that they can from the bent or crouched position. The player would then return to the standing position, and with the golf ball 24 still marked, would place the golf ball aligning device 10 over the golf ball 24 so that the golf ball 24 is fit over the ball opening 20 and against the bottom edge 22. The player then aligns the alignment grid 28 with the target crosshairs 26 to align them 54 as shown in FIG. 4. This allows the player to be able to line up the putt from a better line of site (standing behind the golf ball 24) by just turning the golf ball alignment device 10 in his hands until the desired line of the putt is reached 56. The player would then carefully remove the golf ball alignment device 10 from the golf ball 24 as to not move the golf ball 24 off the target line 5. The player would then remove the mark from behind the golf ball 24 and then address the ball 60 and take their stroke as shown in FIG. 5.

Along with helping with the alignment of the putt, this system and method will also help in striking the golf ball 24 squarely when taking a shot. After having lined up a shot with the method previously described, the player would take their putting stance and line up the front face 18 of the putting head 16 parallel to the target crosshairs 26 on the golf ball 24, thus when taking the shot, this ensures that the golf ball 24 would follow the desired trajectory to the hole.

Figure 6:
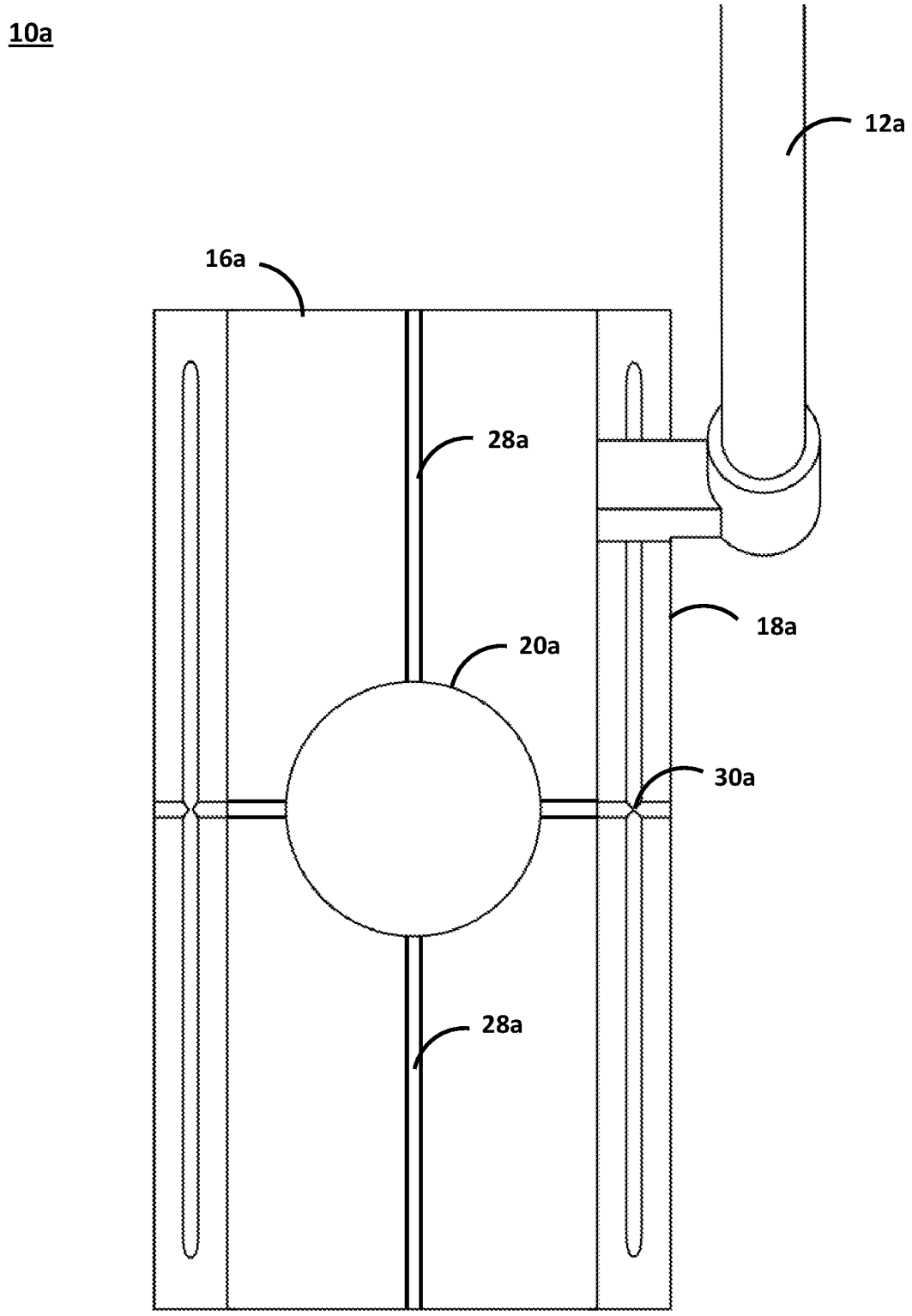
FIG. 6 is a top view of another embodiment of golf ball aligning device.
Figure 7:
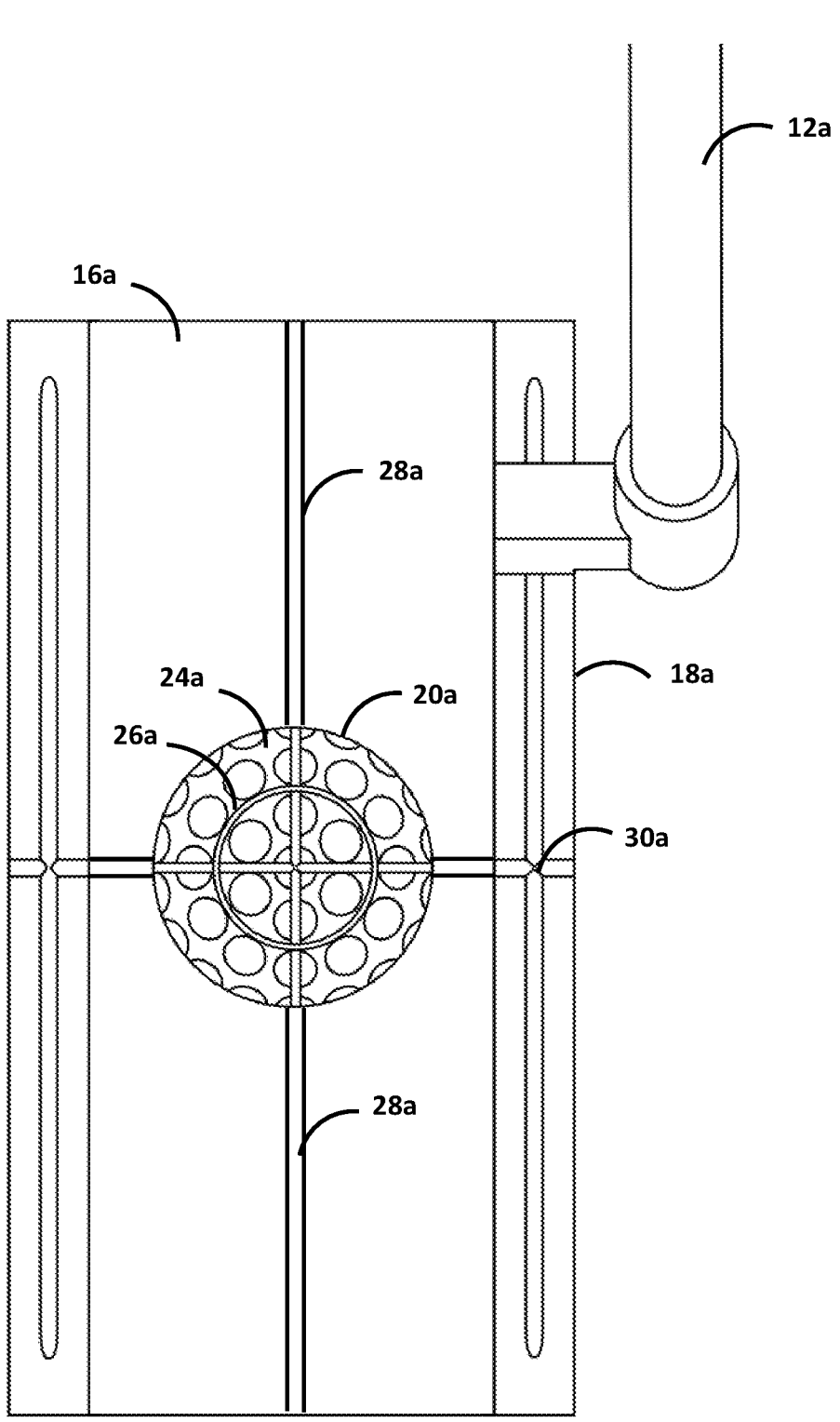
FIG. 7 is a top view of the golf ball aligning device of FIG. 6 with a golf ball positioned in the ball opening.
Figure 8:
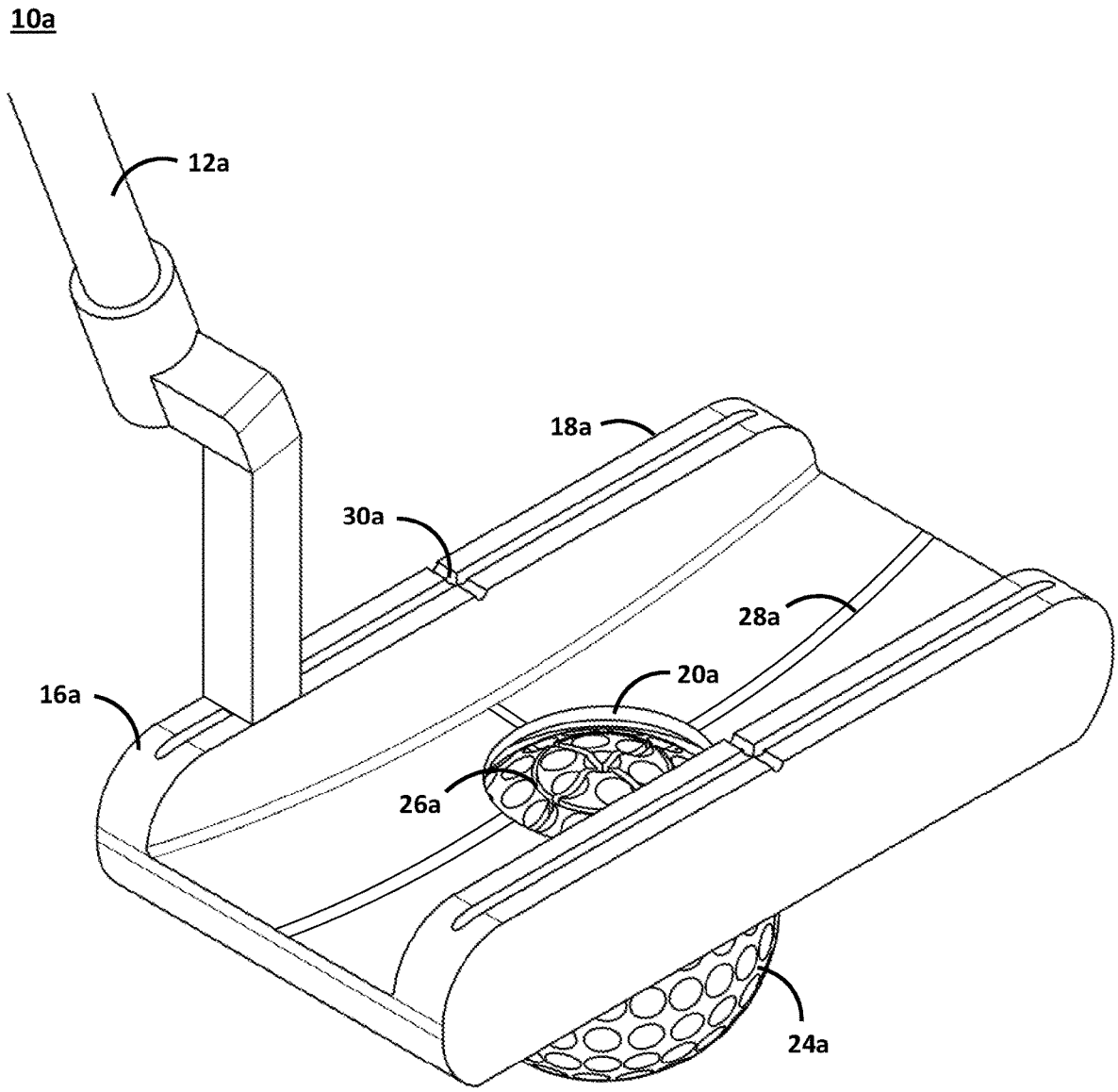
FIG. 8 is a perspective view of the golf ball aligning device of FIG. 7.

Other configurations of golf ball alignment devices are also possible. FIGS. 6 through 8 show a golf ball alignment device 10*a* that incorporates a head member 16*a* that is a different style of putter head. In this embodiment, the ball opening 20*a* is a circular opening that runs through the head member 16*a* and the alignment grid 28*a* is in line with the striking grid 30*a*.

Figure 9:
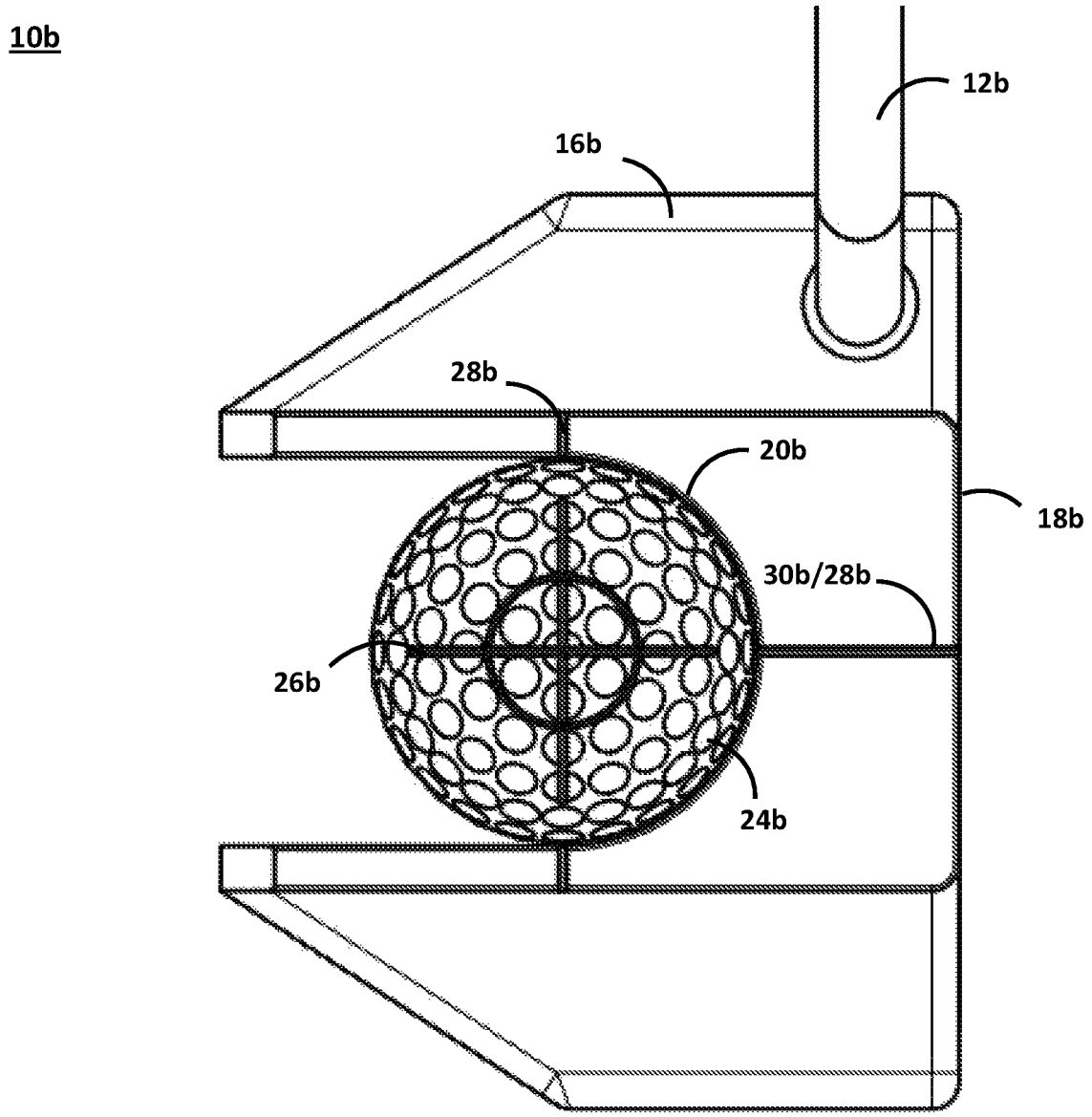
FIG. 9 is a top view of another embodiment of golf ball aligning device having a ball in its semicircular ball opening.
Figure 10:
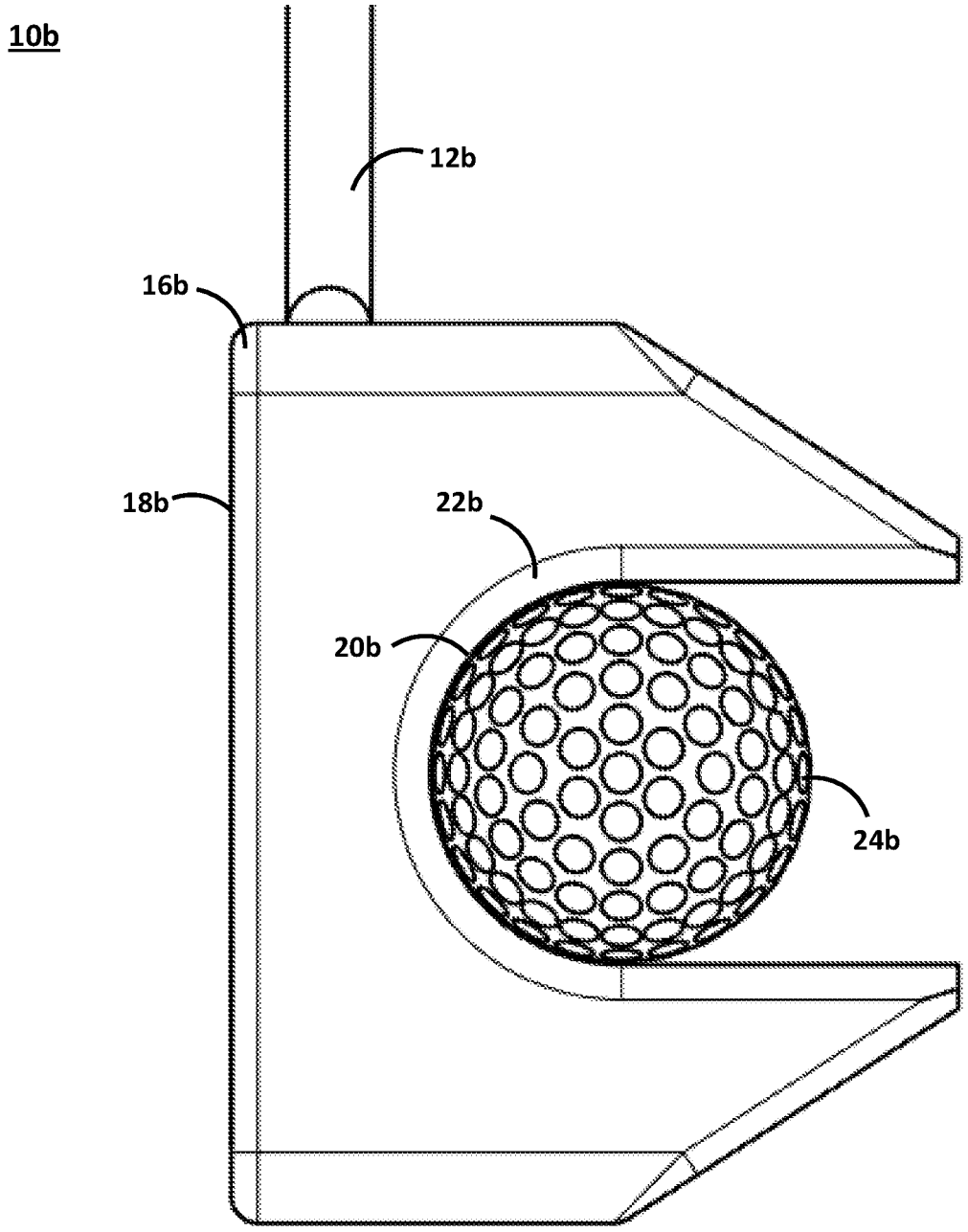
FIG. 10 is a bottom view of the golf ball aligning device of FIG. 9 with a golf ball positioned in the ball opening.
Figure 11:
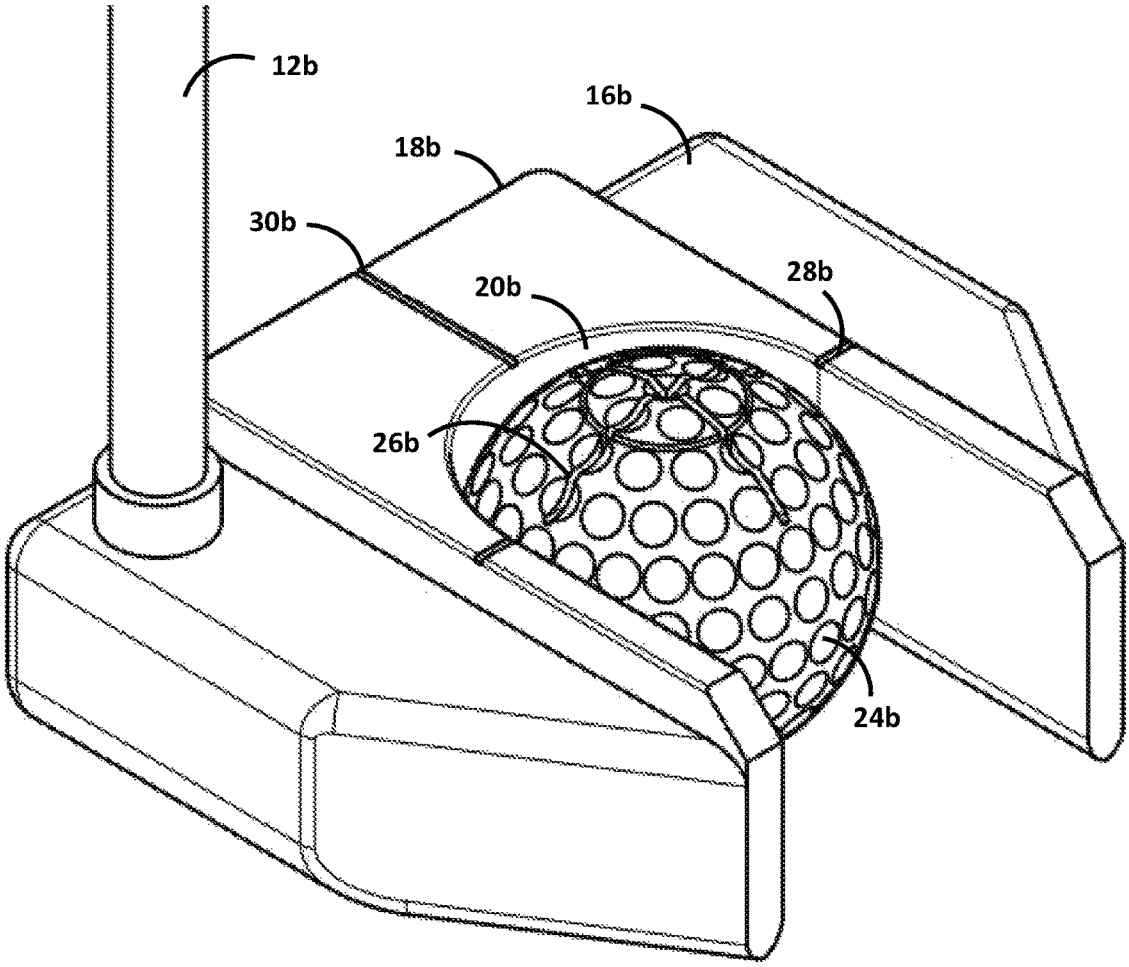
FIG. 11 is a perspective view of the golf ball aligning device of FIG. 10.

Other styles of putting head may similarly incorporate the claimed features of the golf ball alignment device. The embodiment shown in FIGS. 9 through 11 for example has a ball opening 20*b* that is a semicircular section connected to a channel that opens to the back face of the golf ball alignment device 10*b*. The ball opening 20*b* in this embodiment would allow for varied manipulation and release of the golf ball 24*b* from the golf ball alignment device 10*b*. In this embodiment, the alignment grid 28*b* comprises a crosshair pattern centered with the ball opening 20*b* which also acts as the striking grid 30*b* at the top face of head member 16*b*.

Figure 12:
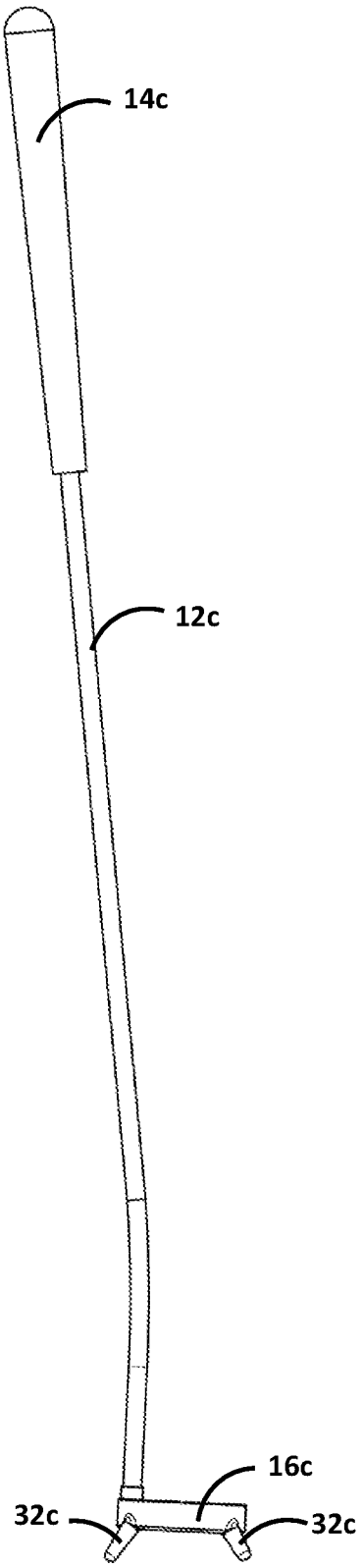
FIG. 12 is a side view of another embodiment of golf ball aligning device.
Figure 13:
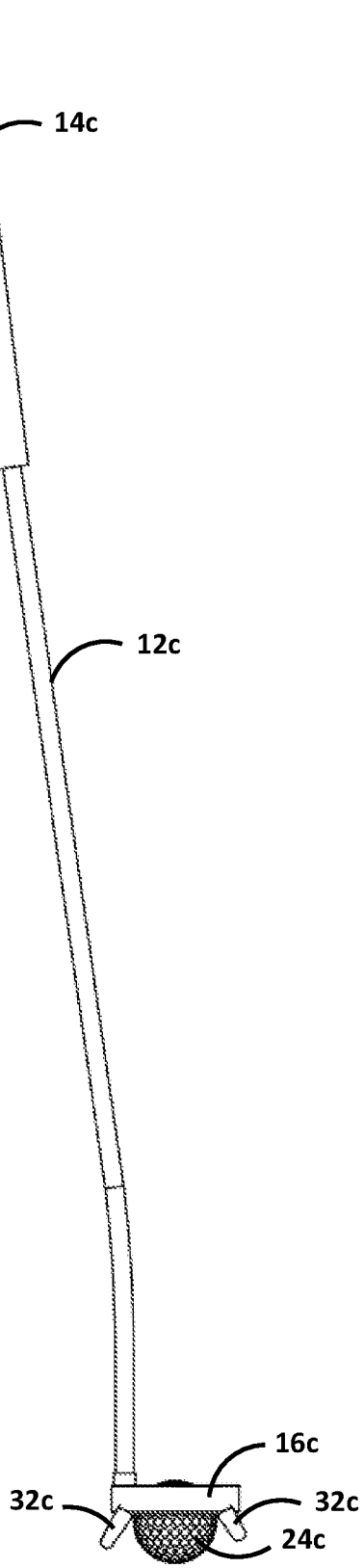
FIG. 13 is a side view of the golf ball aligning device of FIG. 9 with a golf ball positioned in the ball opening.
Figure 14:
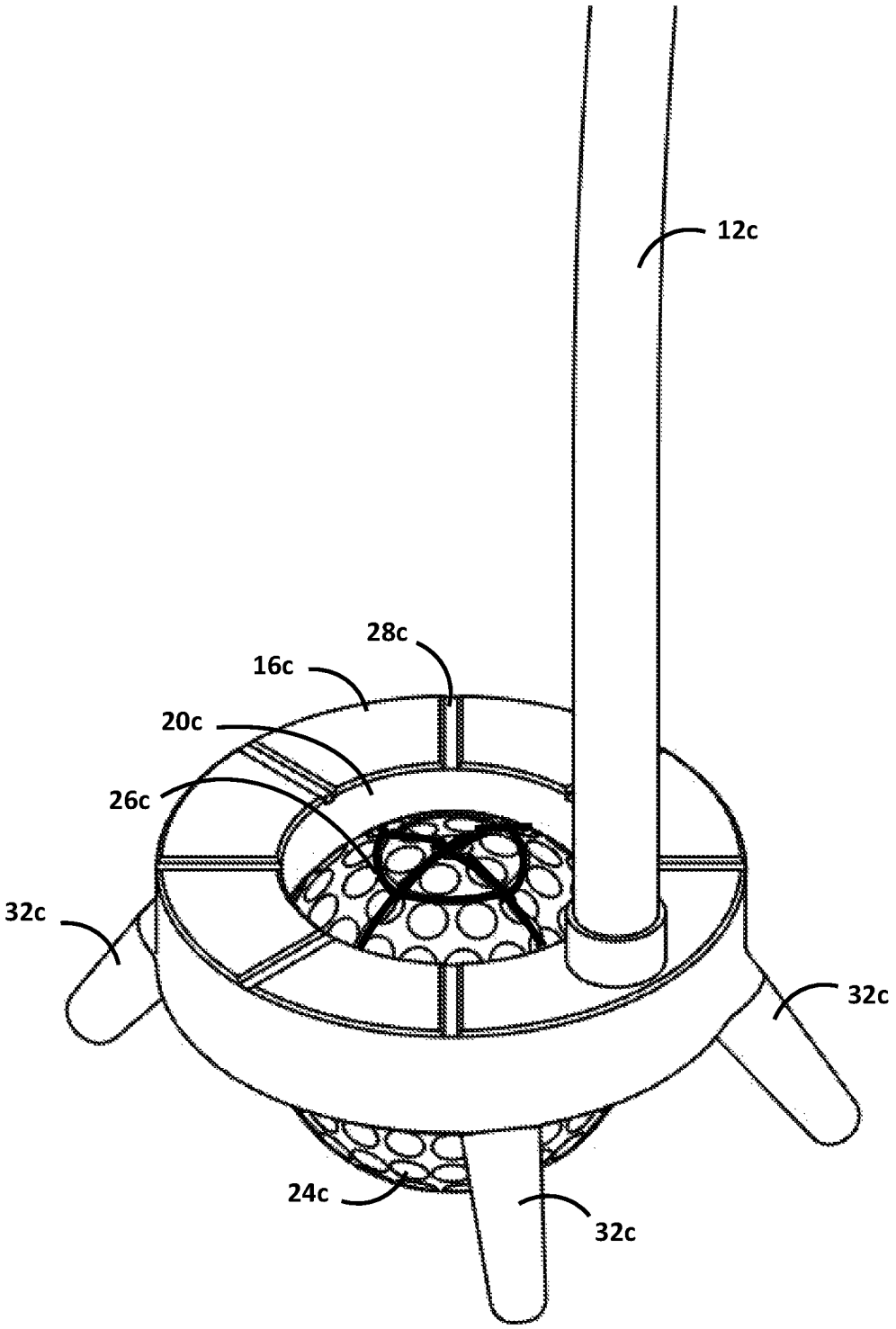
FIG. 14 is a perspective view of the golf ball aligning device of FIG. 10.
Figure 15:
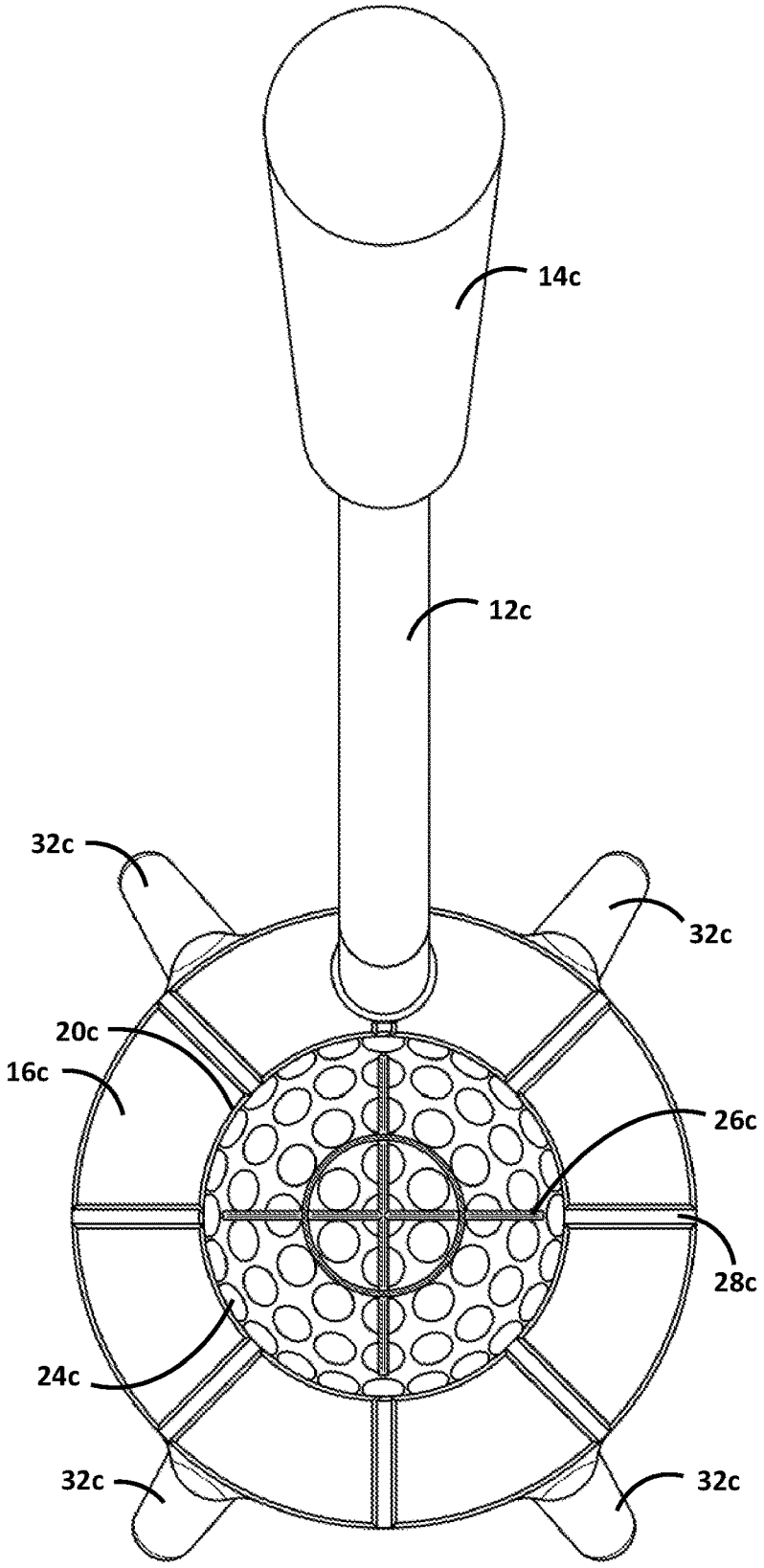
FIG. 15 is a top view of the golf ball aligning device of FIG. 10.
Figure 16:
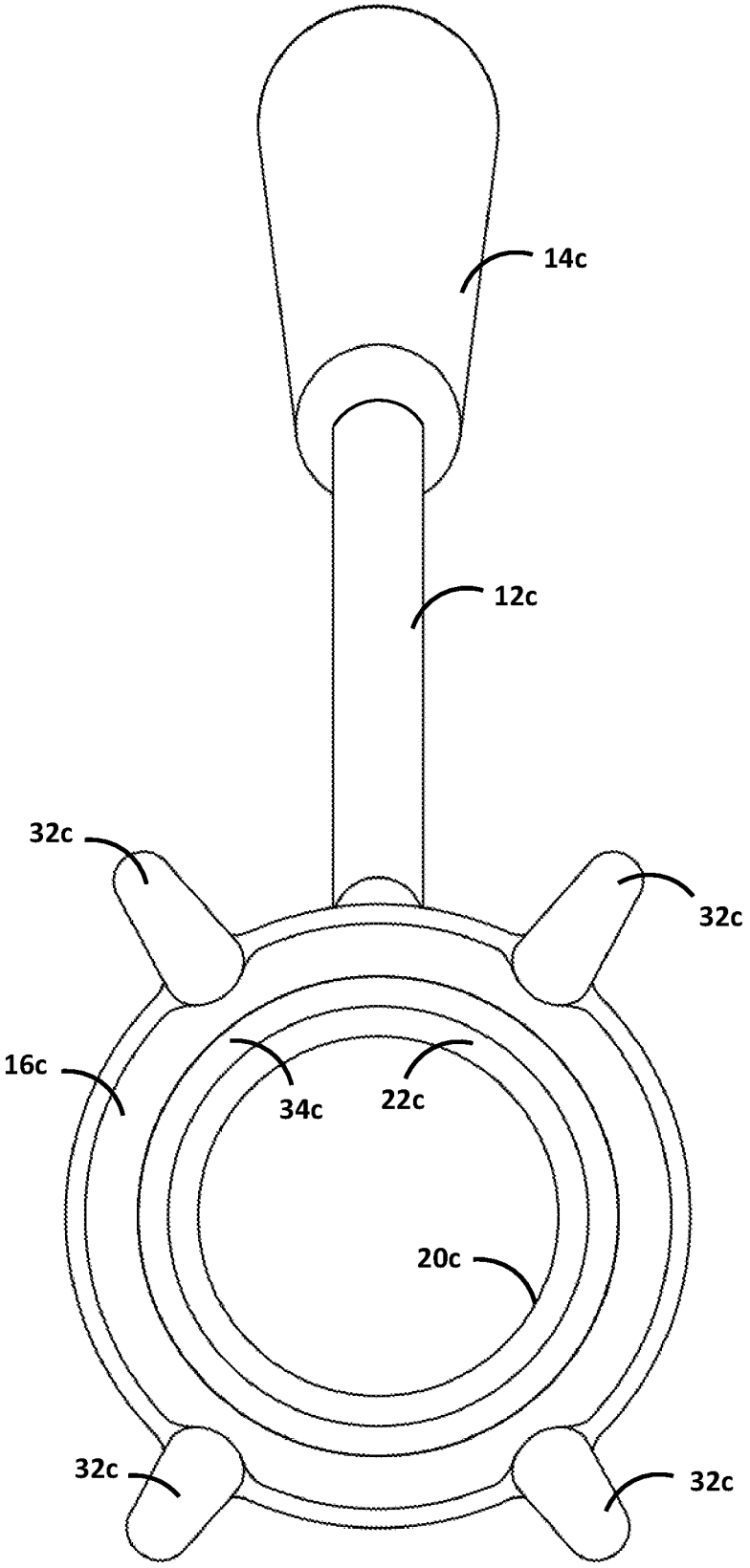
FIG. 16 is a bottom view of the golf ball aligning device of FIG. 9.
Figure 17:
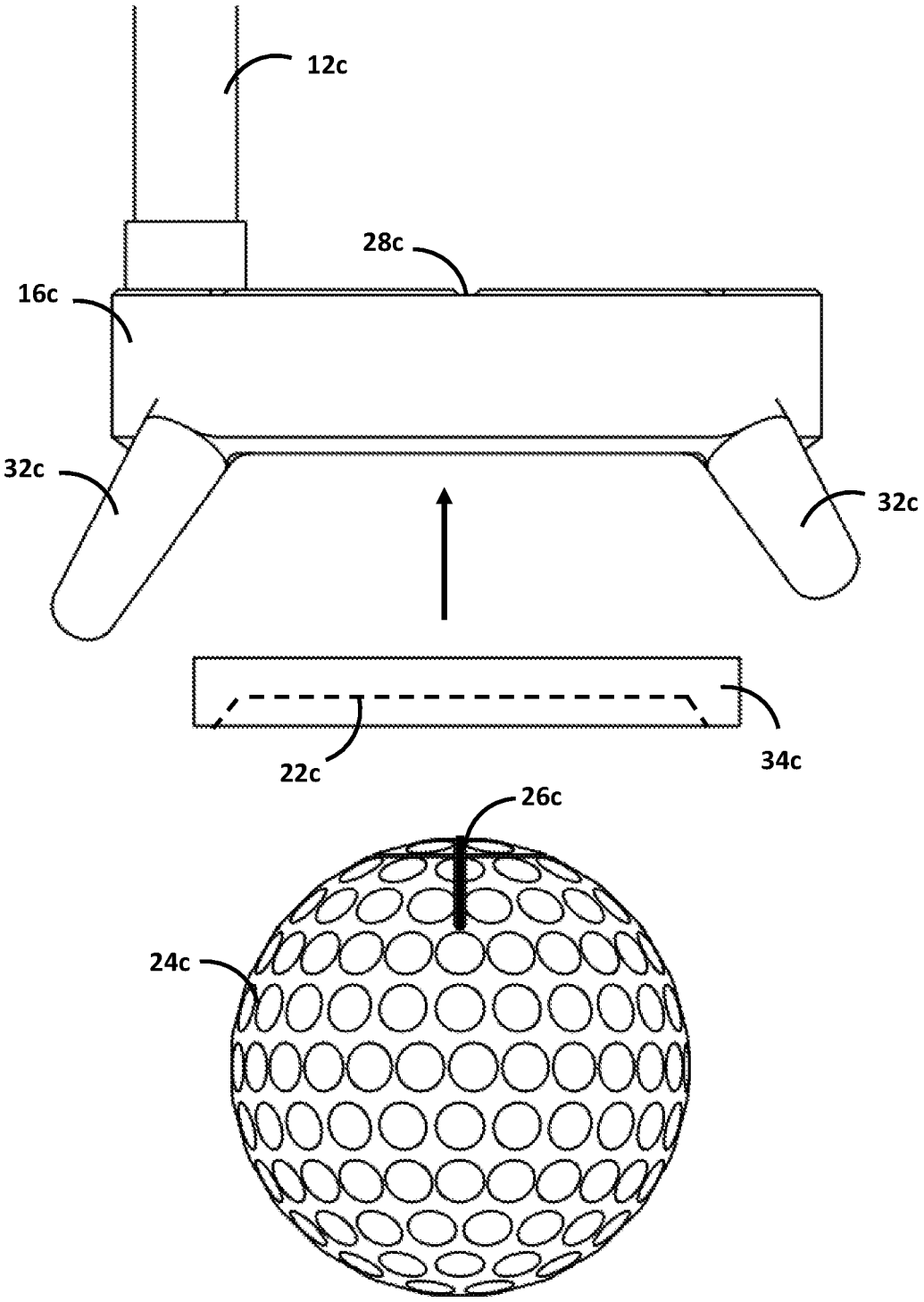
FIG. 17 is a side exploded view of the golf ball aligning device of FIG. 12.
Figure 18:
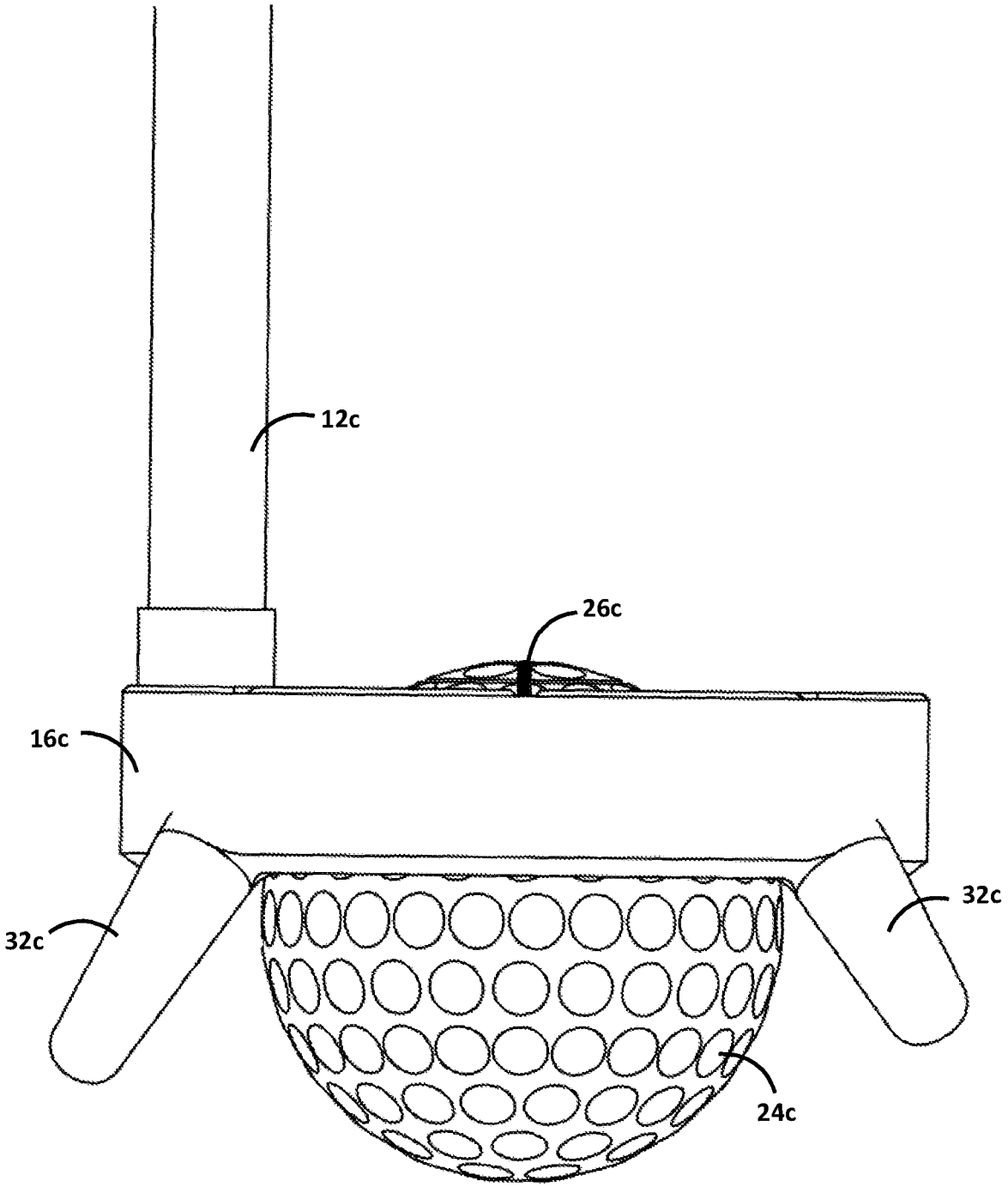
FIG. 18 is a side view of the golf ball aligning device of FIGS. 12.

Golf players can be notoriously picky about their golf clubs and for such players, it would be advantageous for the golf ball alignment device to not incorporate a putting head. FIGS. 12 through 18 show another embodiment of the golf ball alignment device 10*c* is not a golf club but a stand-alone device. The head member 16*c* in this embodiment allows the golf ball alignment device 10*c* to be stood upright when not in use as shown in FIG. 12. The head member 16*c* has a plurality of legs 32*c* extending downwards from the head member 16*c* to support the golf ball aligning device 10*c* in an upright position when not engaged with a golf ball 24*c* as shown in FIG. 12. The height of the legs 32*c* is such that they do not interfere with the movement of the golf ball 24*c* as required to orient it as described with the earlier embodiments. It will be understood that the legs 32*c* shown are not the only configuration that would allow the golf ball alignment device 10*c* to stand upright when not in use and that other configurations are also possible As shown in FIGS. 14 and 15, the alignment grid 28*c* in this embodiment has markings on the circumference of the ball opening 20*c*. This allows the user flexibility with the orientation of the golf ball alignment device 10*c* when used to orient the golf ball 24*c*. As shown in FIGS. 16 through 18, the bottom edge 22*c* incorporates an insert 34*c* made from a low-friction material having a chamfered or rounded inner edge. The insert 34*c* is press fit into a counterbore in bottom edge 22*c*. This allows for customization of the bottom edge 22*c* material to be of a different material than that of the head member 16*c*.

This invention has been described with reference to several preferred embodiments. Many modifications and alterations will occur to others upon reading and understanding the preceding specification. It is intended that the invention be construed as including all such alterations and modifications in so far as they come within the scope of the appended claims or the equivalents of these claims.

What is claimed is:

1. A method for using a golf ball aligning device to align the trajectory of a golf ball shot comprising:

wherein a golf ball aligning device has a shaft having a first and a second end, a handle situated over the first end, and a head member mounted to the second end that comprises a ball opening extending through a height of the head member having a chamfered or rounded bottom edge to engage a golf ball and an alignment grid on a top face of the head member comprising a crosshair pattern centered with the ball opening;

wherein a golf club has a striking face against which the golf club is used to strike a golf ball;

wherein a golf ball has target crosshairs marked on its surface;

selecting a projected trajectory for a golf ball shot;

placing the golf ball on a golf game surface with the target crosshairs aligned with a direction of the projected trajectory;

engaging the golf ball in the chamfered or rounded bottom edge of the golf ball aligning device such that the alignment grid is oriented with the target crosshairs on the surface of the golf ball;

orienting the golf ball with the aligning device such that the alignment grid lines up the golf ball in the direction of the projected trajectory;

removing the aligning device from over the ball such that the target crosshairs remain oriented in the direction of the projected trajectory; and aligning a golf club with the target crosshairs on the golf ball such that the striking face will contact the golf ball at the correct position and angle to drive the golf ball towards the projected trajectory.

2. The method of claim 1 wherein the golf ball aligning device is incorporated into said golf club.

* * * * *